United States Patent [19]

Rech et al.

[11] 4,219,757

[45] Aug. 26, 1980

[54] GAS DISCHARGE LAMP

[75] Inventors: Werner Rech, Taunusstein; Wolfgang Welsch, Wiesbaden; Josef Zimlich, Taunusstein, all of Fed. Rep. of Germany

[73] Assignee: Heimann GmbH, Wiesbaden, Fed. Rep. of Germany

[21] Appl. No.: 888,841

[22] Filed: Mar. 22, 1978

[30] Foreign Application Priority Data

Mar. 28, 1977 [DE] Fed. Rep. of Germany ..... 2713702

[51] Int. Cl.[2] ..... H01J 6/36

[52] U.S. Cl. ..... 313/220; 313/224

[58] Field of Search ..... 313/220, 493, 224

[56] References Cited

U.S. PATENT DOCUMENTS

| | | | |
|---|---|---|---|
| 3,275,879 | 9/1966 | Demarest et al. | 313/220 X |
| 3,693,007 | 9/1972 | Kerekes | 313/220 UX |
| 3,886,392 | 5/1975 | Barakitis et al. | 313/220 |
| 4,052,635 | 10/1977 | Jacobs | 313/220 X |

FOREIGN PATENT DOCUMENTS 748625 11/1944 Fed. Rep. of Germany .

*Primary Examiner*—Rudolph V. Rolinec
*Assistant Examiner*—Darwin R. Hostetter
*Attorney, Agent, or Firm*—Hill, Van Santen, Steadman, Chiara & Simpson

[57] ABSTRACT

A gas discharge lamp having a glass tube with preformed sintered glass bodies sealed to each end with each body carrying at least one connector pin for an electrode so that at least one electrode is disposed and supported adjacent each end of the discharge tube. The glass bodies may be sealed in the discharge tube either by glass solder, an organic adhesive or a combination of both.

15 Claims, 1 Drawing Figure

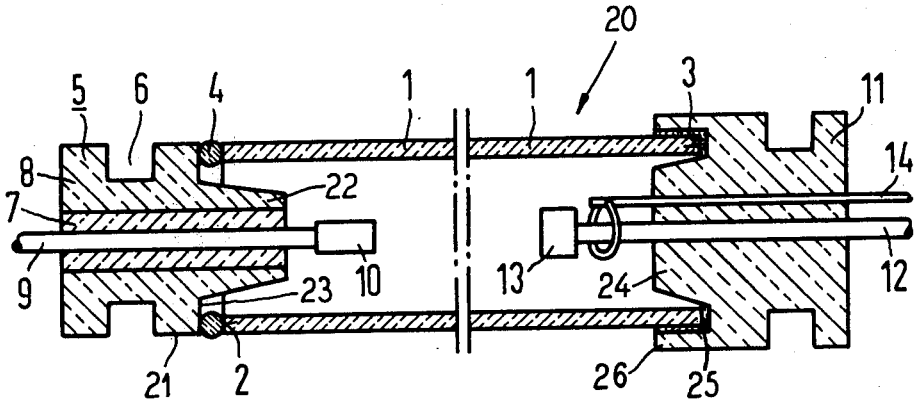
20
5
6
4
1
1
3
11
8
22
14
7
9
23
10
13
24
12
21
2
26
25

GAS DISCHARGE LAMP

BACKGROUND OF THE INVENTION

1. Field of the Invention

The present invention is directed to a gas discharge lamp and particularly a flash tube which has a glass tube and at least two electrodes which are connected in a gas tight fashion by an intermediate glass at the ends of the glass tube.

2. Prior Art

A gas discharge lamp which is used for a flash tube is disclosed in an article by C. Meyer, "Recent Developments In Electronic-Flash Lamps", *Philips Technical Review,* Vol. 22, 1960/61, No. 12, pages 377–390. The flash tube such as disclosed in this article in the simplest circumstances may consist of a straight piece of glass tube which has an electrode fused in a gas tight fashion at each end so that an anode is disposed adjacent one end and cathode is at the other end. Generally, the anode consists of tungsten or molybdenum and the cathode consists of a sintered body which comprises saturating substances that are composed of emission materials and getter materials which are well known and described, for example, in German printed patent AS No. 23 32 588. The discharge tube or lamp is filled with an inert gas preferably xenon on account of its spectral light distribution, which is similar to natural daylight. An ignition or triggering electrode is generally located on the outside of the tube.

To initiate the gas discharge, the ignition or triggering electrode initiates the gas discharge between itself and the cathode by producing an electrical field which raises as rapidly as possible and, therefore, the gas adjacent the cathode becomes ionized due to the effects of the field and causes a gas discharge to take place. This gas discharge will extend in the direction of the anode until the field strength of the electrical field prevailing between the cathode and the anode becomes of such a magnitude due to displacement of the part of the gas which has not become ionized that the remaining gas is also ionized. Consequently, the main gas discharge between the cathode and anode is triggered. Initiation of the gas discharge can also take place without a separate ignition or triggering electrode if a so-called "overhead ignition" occurs in which the anode receives an adequate voltage pulse.

The glass tube which serves as a discharge vessel consists of quartz crystal glass or hard glass having a very high melting point. The electrode material or at least the material of the metal or metallic electrodes may be lines or connector pins, which pass through a gas tight seal of the glass tube and extends to the actual electrode arranged inside the glass tube, must be selected to be such that the different coefficients of thermal expansion between the material of the electrical connector pin and the glass tube do not lead to cracks in the gas tight connection or seal. When hard glass is used for the glass tube, this matching can be effected by selecting tungsten for the electrodes or at least for the portion of the electrical connector pin extending through the glass envelope and by matching the coefficient of thermal expansion of the tungsten with a hard glass of appropriate composition. It should be noted that matched glass of this type is commercially available.

In the case of a quartz crystal glass, a direct matching is not possible. In this instance, as in the case when a hard glass is used in fact for the glass tube, but for economic reasons and primarily to reduce cost, nickel is used as the connector pin instead of the more expensive tungsten, a transition element composed of an intermediate glass must be provided in order to match different coefficients of thermal expansion.

Although tungsten in combination with a matched hard glass has an advantage in comparison with other metals that no intermediate glass is required, the cost of tungsten is relatively high and tungsten cannot be soldered. A compromise of using expensive metal, which can sustain a high thermal load, only for the actual electrodes, of employing a sintered body for the cathode, and of producing the electrical connector pins for the two electrodes from a cheap metal necessitates utilizing an intermediate glass, which results in an equally expensive solution due to the high cost of the process steps which are required.

SUMMARY OF THE INVENTION

The present invention is directed to providing a selection of materials for the glass tube and for the electrode supply lines or connector pins which avoids the disadvantage of different coefficients of thermal expansion and nevertheless achieves a structure which is simple and inexpensive to construct with respect to production technology.

In order to accomplish these tasks, a gas discharge lamp particularly useful as a flash tube comprising a glass tube containing at least two electrodes and an inert gas, a preformed sintered glass body for each end of the glass tube, and means for securing the glass bodies in each end with a gas tight seal, each glass body having at least one electrical connector pin for an electrode extending therethrough in a sealed fashion so that the glass tube has an electrode adjacent each end to act on the inert gas contained therein.

Each of the preformed sintered glass bodies can be cheaply and mechanically produced. The use of the preformed bodies of known intermediate glass and securing these bodies to the tube eliminates the need for expensive glass blowing operations. A further advantage comprises the fact that the sintered glass body of this kind can be produced in arbitrary shapes with accurate dimensions. The supply lines or electrical connector pin, which simultaneously constitute the mechanical support for the actual electrodes, are fused into the sintered glass bodies. This can be accomplished simultaneously with the production of the body.

With the structure of the discharge tube of the present invention, the glass tube during the assembly process can possess a length which exhibits the approximately final length with extremely narrow tolerances. Thus, when the glass bodies are sealed into the glass tube by accurately dimensioned sealing process which may comprise either soldering or gluing utilizing an adhesive, the electrodes assume a clearly defined position relative to one another. This enables the accurate setting of the focal length during the actual production of the gas discharge tube and thus is a decisive factor regarding the light strength irradiated during the gas discharge of the tube. Furthermore, the use of a glass tube, which has its approximate final length prior to forming the closure, provides the advantage of eliminating waste of excess glass.

The fact that the sintered glass body is pre-produced, advantageously allows the body to be designed in such a manner that it serves not only as a closing body for the glass tube and as a support for the electrode and the supply line, but also as a support for the discharge lamp itself. This facilitates a precise adjustment of the gas discharge lamp. If a gluing of the sintered glass body to the glass tube, which is one means of forming the seal, is utilized, the layer of glue may be extended beyond a level which guarantees a gas seal and it is therefore possible to produce an elastic support of the glass tube on the glass body.

The glass type connection of the sintered glass bodies to the glass tube can be effected either by employing a conventional organic adhesive or by a glass solder and it is also possible to carry out the adhesion in addition to soldering. In an advantageous embodiment, the glass solder is provided with additions, for example, iron oxide which will absorb infrared radiation from an infrared lamp. Thus, with this type of solder, a preheated assembly can have the solder brought to the final melting point by the use of infrared radiation.

It is also advantageous and particularly with respect to a satisfactory adjustment of the focal length to use the end surfaces of the tube ends as soldering surfaces of adhesive surfaces.

Finally, in an advantageous embodiment of the invention, the sintered glass bodies are constructed from a plurality of concentric layers having different coefficients of thermal expansion. As a result of the different layers, a thermal matching of the selected glass material of the tube to the material of the electrical connector pin or supply line is improved and the selection can be carried out more freely. Furthermore, a connector pin for an additional electrode, for example, to assist in the ignition or triggering of the lamp or for gettering purposes can also be passed through out of the sintered glass bodies. Therefore, a separate ignition or triggering electrode, which is arranged on the exterior of the glass tube, becomes unnecessary.

BRIEF DESCRIPTION OF THE DRAWINGS

The FIGURE illustrates an illustrative embodiment of a gas discharge such as used as a flash tube in accordance with the present invention.

DETAILED DESCRIPTION OF THE PREFERRED EMBODIMENT

The principles of the present invention are particularly useful in a gas discharge tube generally indicated at 20 in the drawing. The gas discharge tube 20 includes a glass tube 1 which is composed of either a boron silicate glass, quartz crystal or a glass which is capable of withstanding the temperature load and is transparent to the light produced in the flash tube 20. Preferably, the tube 1 has a circular cross section and is provided with annular end surfaces 2 and 3 at its two ends. It should be noted that while the tube 1 is illustrated as a straight tube, it could be bent in any particular configuration such as U-shaped or circular-shaped or any other complicated form.

A preformed sintered glass body 5 is secured to an end surface 2 by means for securing such as a glass solder 4. The glass solder can be applied to the surfaces to be soldered such as the end surface 2 as a glass solder ring or by means of a silk screen printing process of a solder paste. The body 5 has a cylindrical outer surface 21 with a conical end projection 22 which was connected by a flat annular surface or shoulder 23. Due to the fact that the outer diameter of the tube 1 and the outer diameter of the surface 21 of the body 5 are substantially the same, the annular shoulder 23 forms a solder surface which lies opposite the end surface 2 of the tube 1.

The body 5 is illustrated as having an annular groove 6 which has a rectangular cross section. This groove 6 can serve as means to support the gas discharge tube 20.

The sintered glass body 5 is illustrated as being composed of two concentric layers 7 and 8 which are arranged coaxially within one another. Along the axis of the body 5, an electrical connector pin 9 which is in gas tight sealing relation with the layer 7 is provided and is secured to an anode 10.

The two layers 7 and 8 of the sintered glass body 5 have different coefficients of thermal expansion. This enables the coefficient of thermal expansion of the material of the connector pin 9 and the material of the glass tube 1 to be matched in stages. The continuity of matching produces fewer mechanical stresses during thermal loading. The connector pin 9 preferably consists of an NiFe alloy or an NiFeCo alloy. An anode 10 consisting of tungsten or molybdenum is welded onto the inner end of the connector pin 9. In order to simplify the production process, the connector pin 9 and anode 10 can consist of one single component in which molybdenum is a preferred material for cost reasons. Thus, the connector pin 9 depending on whether it is separate or integral with the anode 10 is constructed of a material selected from a group consisting of NiFe alloy, NiFeCo alloy and molybdenum. Preferably, the common length of the connector pin 9 within the sintered glass body 5 is as large as possible. A long fusion path between the body 5 and the connector pin 9 reduces dangers of the formation of hairline cracks.

At its other end surface 3 of the tube 1, and the adjoining end of the peripheral surface of the tube 1, the tube 1 is glued to an appropriately shaped sintered glass body 11 by sealing means comprising an adhesive. As illustrated, the body 11 has a conical projection 24, an annular surface 25 and annular flange 26. Except for the flange 26, the shape of the preformed sintered glass body 11 corresponds substantially to that of the sintered glass body 5. However, the body 11 is not provided with multiple layers of different materials. In addition, the body 11 supports both a supply line or connector pin 12 for the cathode 13 and a second supply line or connector pin 14 which serves as ignition electrode and/or for gettering purposes.

Beyond this exemplary embodiment, other embodiments are possible within the scope of the invention. In fact, the design freedom with regard to the shape of the tube 1 and the shape of the sintered glass bodies 5 or 11 constitutes an important advantage of the gas discharge lamp in accordance with the present invention. Even in the case of a complicated shape of the tube 1, no separate pump connection components are required for pumping out the tube 1 or filling the tube 1 with a filling gas because the gas tight seal including the insertion of the electrodes can be carried out at one single location is consecutive processes. Furthermore, in addition to the described exemplary embodiments, other embodiments are possible with respect to the electrode design, for example, an electrode design for symmetrical gas discharge lamps, anodes and cathodes composed of the same sintered body or for additional application of an outer ignition electrode in the form of a wire winding which is known per se.

Although various minor modifications may be suggested by those versed in the art, it should be understood that we wish to embody within the scope of the patent warranted hereon, all such modifications as reasonably and properly come within the scope of our contribution to the art.

We claim:

1. A glass discharge lamp particularly useful as a flash tube comprising a glass tube having end surfaces and containing at least two electrodes and inert gas; a preformed glass body of sintered glass particles for each end of the glass tube, each preformed glass body having an annular shoulder with a conical end extended therefrom and having at least one electrical connector pin for an electrode extending therethrough in a sealed fashion, said preformed glass bodies being arranged with the conical and extending into the tube; and means for securing each preformed glass body to the glass tube including a glass solder seal extending between each end surface of the tube and the annular shoulder of the body disposed therein to form a gas tight seal so that the glass tube has an electrode disposed adjacent each end to act on an inert gas contained therein.

2. A gas discharge lamp according to claim 1, wherein the means for securing the body to the glass tube additionally includes an adhesive.

3. A gas discharge lamp according to claim 1, wherein each of the preformed glass bodies are sintered from a glass solder.

4. A gas discharge lamp according to claim 1, wherein the glass solder consists of a glass which absorbs infrared radiation.

5. A gas discharge lamp according to claim 4, wherein the glass solder contains additions of iron oxide.

6. A gas discharge lamp according to claim 1, wherein the glass bodies are composed of at least two concentric layers of materials with the layers having different coefficients of thermal expansion.

7. A gas discharge lamp according to claim 1, wherein each of the preformed glass bodies has an external surface providing a support for mounting the gas discharge lamp.

8. A gas discharge lamp according to claim 1, wherein one of the preformed glass bodies contains an additional electrode connector pin extending therethrough, said additional connector pin being provided for ignition and/or gettering purposes.

9. A gas discharge lamp according to claim 1, wherein at least one of the electrode connector pins is selected from a material selected from a group consisting of NiFe alloy, NiFeCo alloy and molybdenum.

10. A glass discharge lamp particularly useful as a flash tube comprising a glass tube having end surfaces and containing at least two electrodes and inert gas; a preformed glass body of sintered glass particles for each end of the glass tube, each preformed glass body having an annular shoulder with a conical end extending therefrom and having at least one electrical connector pin for an electrode extending therethrough in a sealed fashion, said preformed glass bodies being arranged with the conical end extending into the tube; and means for securing each preformed glass body to the glass tube including an organic adhesive extending between each end surface of the tube and the annular shoulder of the body disposed therein to form a gas tight seal so that the glass tube has an electrode disposed adjacent each end to act on an inert gas contained therein.

11. A gas discharge lamp according to claim 10, wherein each preformed glass body has an axial flange extending from the annular shoulder telescopically receiving a portion of the tube and the organic adhesive extends between the flange and the tube in order to achieve an elastic support for the glass body on the glass tube.

12. A gas discharge lamp according to claim 10, wherein the glass bodies are composed of at least two concentric layers of material with the layers having different coefficients of thermal expansion.

13. A gas discharge lamp according to claim 10, wherein each of the preformed glass bodies has an external surface groove providing a support for mounting the gas discharge lamp.

14. A gas discharge lamp according to claim 10, wherein one of the preformed glass bodies contains an additional electrode collector pin extending therethrough, said additional connector pin being provided for ignition and/or gettering purposes.

15. A gas discharge lamp according to claim 10, wherein at least one of the electrode connector pins is selected from a material selected from a group consisting of NiFe alloy, NiFeCo alloy and molybdenum.

* * * * *